United States Patent [19]

Frappe

[11] 3,943,422

[45] Mar. 9, 1976

[54] METHOD AND APPARATUS FOR THE PHOTO-ELECTRICAL READING-IN WEAVING DESIGNS

[75] Inventor: Pierre Frappe, Lyon, France

[73] Assignee: Verdol S.A., Caluire, France

[22] Filed: Apr. 24, 1974

[21] Appl. No.: 463,553

[30] Foreign Application Priority Data

May 21, 1973 France ..... 73.19011

[52] U.S. Cl. ..... 318/568; 318/696

[51] Int. Cl.[2] ..... G05B 19/42

[58] Field of Search ..... 318/568, 696

[56] References Cited

UNITED STATES PATENTS

| | | | |
|---|---|---|---|
| 2,866,506 | 12/1958 | Hierath et al. | 318/568 X |
| 3,054,036 | 9/1962 | Lenk et al. | 318/568 |
| 3,280,399 | 10/1966 | Kreinberg | 318/696 X |
| 3,297,927 | 1/1967 | Blakeslee et al. | 318/696 |
| 3,373,267 | 3/1968 | Swann | 318/568 X |
| 3,461,365 | 8/1969 | Newland et al. | 318/696 X |
| 3,569,813 | 3/1971 | Clark et al. | 318/696 X |

*Primary Examiner*—Benjamin Dobeck
*Attorney, Agent, or Firm*—Dowell & Dowell

[57] ABSTRACT

In the automatic reading of a weave design from a pattern including weft rows and warp rows, the advance of the reading assembly (photo-electric cells) from one weft row to the next one is effected by a step-by-step electric motor which receives "secondary" pulses from a ring counter to which "primary" pulses are applied, whenever the number of such "primary" pulses received by said counter is equal to the quotient of the number of "primary" pulses required to displace said assembly from one extreme weft row to the other one, divided by the number of weft rows minus one unit, this quotient being taken as an integer.

The incremental advance of the reading assembly for each step of the motor is much smaller than the centering tolerance of said assembly required to place it in front of each weft row, and the number of "primary" pulses required to determine such a step is selected much higher so that the error which results from the fact that the quotient is limited to an integer is also negligible.

6 Claims, 3 Drawing Figures

METHOD AND APPARATUS FOR THE PHOTO-ELECTRICAL READING-IN WEAVING DESIGNS

The designs which are to be reproduced on patterned fabrics are previously established to an enlarged scale in an appropriate number of colors as "squares" on rectangular coordinate paper, the rows of squares in one direction corresponding to the weft threads of the fabric and the rows in the other direction to the warp threads. In the conventional art the sheet of coordinate paper, generally called the "design", is disposed with its weft rows directed horizontally and an operator "reads in" the successive rows from left to right while actuating the control members of a conventional card perforating machine in accordance with the colors of the successive squares, each color corresponding to a particular weave. More recently the reading operation has been effected photoelectrically by means of color-responsive cells which actuate automatically the card perforating machine. With such an automatic system the horizontal disposition of the rows of squares corresponding to the weft looses any significance and it may then only be said that the sheet of squared paper or "design" is comprised of weft rows and warp rows, the photo-electric device following the successive weft rows. The color of each square is generally read at the center of the square and for this purpose an auxiliary photo-electric device may be provided to detect only the lines of the squared paper directed in the warp direction (the lines which define the successive warp rows), the said auxiliary device being angularly offset with respect to the axis of the main one in such manner as to emit a pulse whenever the latter is in front of the center of a square. When the last square of a weft row has been read, the reading assembly should be centered in the front of the first square of the next weft row, which requires a relative displacement both in the weft and in the warp directions.

The displacement in the weft direction merely requires a return stroke in the row scanning direction and it sets no problem. It is possible for this purpose either to reverse the electric motor which scans the reading assembly along the weft rows (or scan the design in this same direction with respect to a stationary reading assembly), or else it is possible to dispose the disign on a rotating drum in such manner that when the reading assembly has left one side of the design, it automatically beings again on the other side without having to effect any return stroke proper. However, on the other hand, the displacement in the warp direction, which corresponds to the intermittent advance from one weft row to the next one, has hitherto been much more difficult to realize.

It is impossible to provide for this purpose a predetermined mechanical advance of the reading assembly since the paper of the design is sensitive to atmospheric moisture content and is not therefore perfectly stable in its dimensions. An auxiliary photo-electric cell may be provided to detect the lines of the rectangular coordinate paper which are parallel to the weft rows. But while the dimensions of the squares as measured in the direction of the weft are practically standardized, they often vary in the direction of the warp and therefore either the auxiliary cell would have to be adjusted in position with respect to the main reading device for each particular case, or the designers should be asked to use squared paper with squares of uniform dimensions.

According to the present invention, the intermittent displacement of the reading assembly in the warp direction from weft row to weft row is effected by means of a step-by-step electric motor, the transmission between this motor and the said assembly being such that the smallest incremental advance of the latter corresponding to each pulsed angular step of the motor will be small than the admissible tolerance required for the centering of the reading assembly with respect to each weft row of the design. The step-by-step motor is energized by successive secondary electric pulses so as to rotate each time through one angular step in response to a large predetermined number of primary pulses. The total number of secondary pulses required to displace the assembly from the center of one of the extreme weft rows of the design to the center of the opposed extreme weft row is counted, and this total number of pulses is divided by total the number of weft rows minus one to obtain a quotient in the form of an integer, and the advance of the reading assembly at the end of each weft row is achieved by applying to the step-by-step motor a number of secondary pulses equal to the said integer.

It will be understood that if the number of primary pulses which corresponds to one angular step of the motor is sufficiently high, the error resulting from the fact that the quotient is taken as an integer becomes negligible, even taking into account the fact that the said error is repeated when passing from each weft row to the next one. As to the error which results from the fact that the minimal angular step of the motor cannot be divided, it is not repeated and it is therefore sufficient that the corresponding incremental displacement of the reading assembly should be smaller than the admissible tolerance concerning the centering of the said assembly in front of a square.

The apparatus used for the carrying into practice of the above-defined method preferably comprises means which, during a preparatory period, will displace the reading assembly from an extreme weft row of the design to the opposed one, means to count the total number of motor stepping pulses emitted during this preparatory step, means to receive the indication of the number of weft rows minus one and to divide said total number of pulses by the said number of rows minus one to obtain a quotient limited to an integer, and means which, during the reading period, are actuated when the reading assembly has reached the end of a weft row to displace the said assembly to the next weft row by moving it in the direction of the warp through a distance which corresponds to a number of pulses equal to the said quotient.

In the annexed drawings

Figure 1:
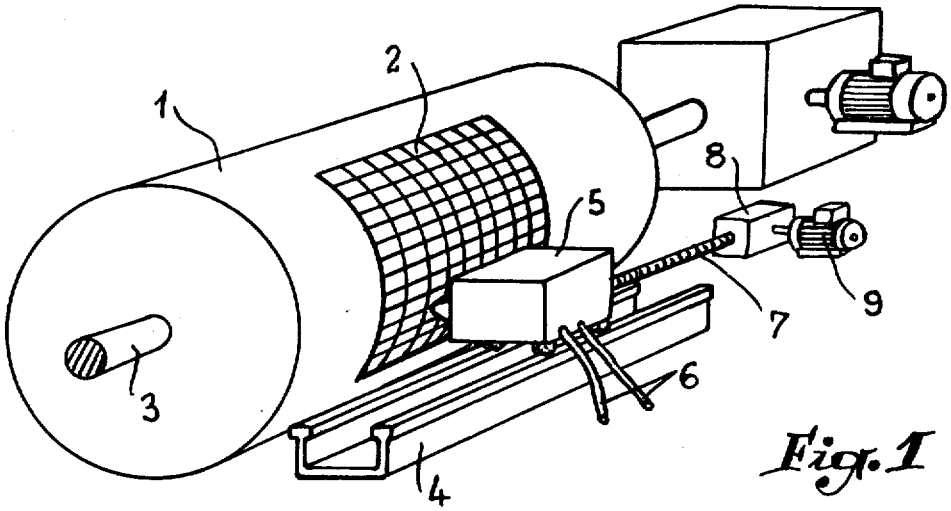
FIG. 1 is a diagrammatic perspective view illustrating a first embodiment of a mechanical apparatus for the photo-electrical reading of a weaving design.

In FIG. 1 a reading device comprises a drum 1 on the periphery of which the design 2 laid out on a rectangular coordinate paper is disposed with its weft rows perpendicular to the axis of the drum, i.e. of its supporting shaft 3. A guide 4 extends along drum 1 in parallel relation to the axis thereof and it slidably receives a carriage on which the reading assembly 5 is disposed, this assembly including in the conventional manner a number of photo-electric cells associated with appropriate color selecting means and with an auxiliary cell adapted to detect the warp lines of the rectangular coordinate paper. Assembly 5 is connected via flexible conductors such as 6 with conventional electric reading circuits which decode the signals from the main cells to actuate a Jacquard card perforating machine (not shown). The displacement of assembly 5 along guide 4 is intermittently effected after each weft row is scanned by appropriate means which in the example illustrated are comprised of a screw 7 which cooperates with a nut (not illustrated) secured to the movable carriage of the assembly 5, the said screw being rotated by a speed-reducing gearing 8 driven by an electric motor 9.

The drum 1 rotates continuously to scan the weft rows past the reading assembly 5 and thus when the reading assembly 5 has left the trailing longitudinal edge of the design 2, it again meets the leading longitudinal edge thereof without having to effect any return stroke. But in the meantime, the screw 7 should be rotated through such an angle that the assembly 5 will be displaced longitudinally, i.e. in the warp direction, through a distance equal to the width of a weft row of the design.

Figure 2:
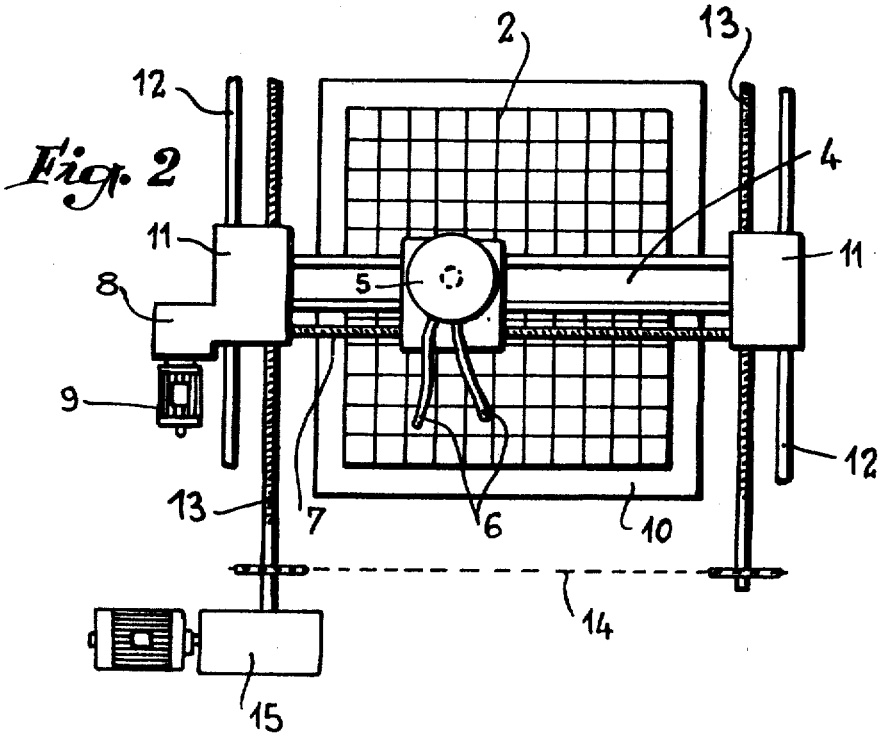
FIG. 2 is a view in elevation of another embodiment.

FIG. 2 illustrates a modification in the mechanical arrangement of the device. Here the rectangular coordinate design 2 is fixed on an appropriate flat support or plate 10. This plate is carried by slides 11 movable on parallel lateral guiding rods 12 to move the plate beneath the reading assembly 5 and scan the rows therepast. Each slid 11 is driven by a rotating screw 13 parallel to each of the rods 12, these screws being mechanically connected with each other by means of a chain 14 and one of them being rotated by a speed-reducing gearing 15, the input shaft of which is driven by an appropriate electric motor. Here again the reading assembly is slidably carried by a guiding bar 4 which extends between slides 11 and it is displaced on this bar or guide by a screw 7 driven by an electric motor 9 through a reducing gearing 8. The weft rows of design 2 are parallel to screws 13. With the arrangement described each time a weft row has been read, the plate 10 must be returned beneath the guiding bar 4 before reading in the next row.

In both cases, the electric motor 9 is of the step-by-step type, i.e. it advances through a pre-determined angle each time it receives an electric pulse signal of sufficient value. This angular step of motor 9 and the transmission ratio of the reducing gearing 8 are so selected that the incremental advance of the reading assembly 5 with respect to the design 2 in the warp direction which results from such a step of the motor should be noticeably smaller than the smallest permissible tolerance for the centering of the said reading assembly with respect to the design in the aforesaid direction. Stated in other words, if the motor is displaced through one step when assembly 5 is exactly centered on a weft row, the reading operation remains nevertheless perfectly correct.

Figure 3:
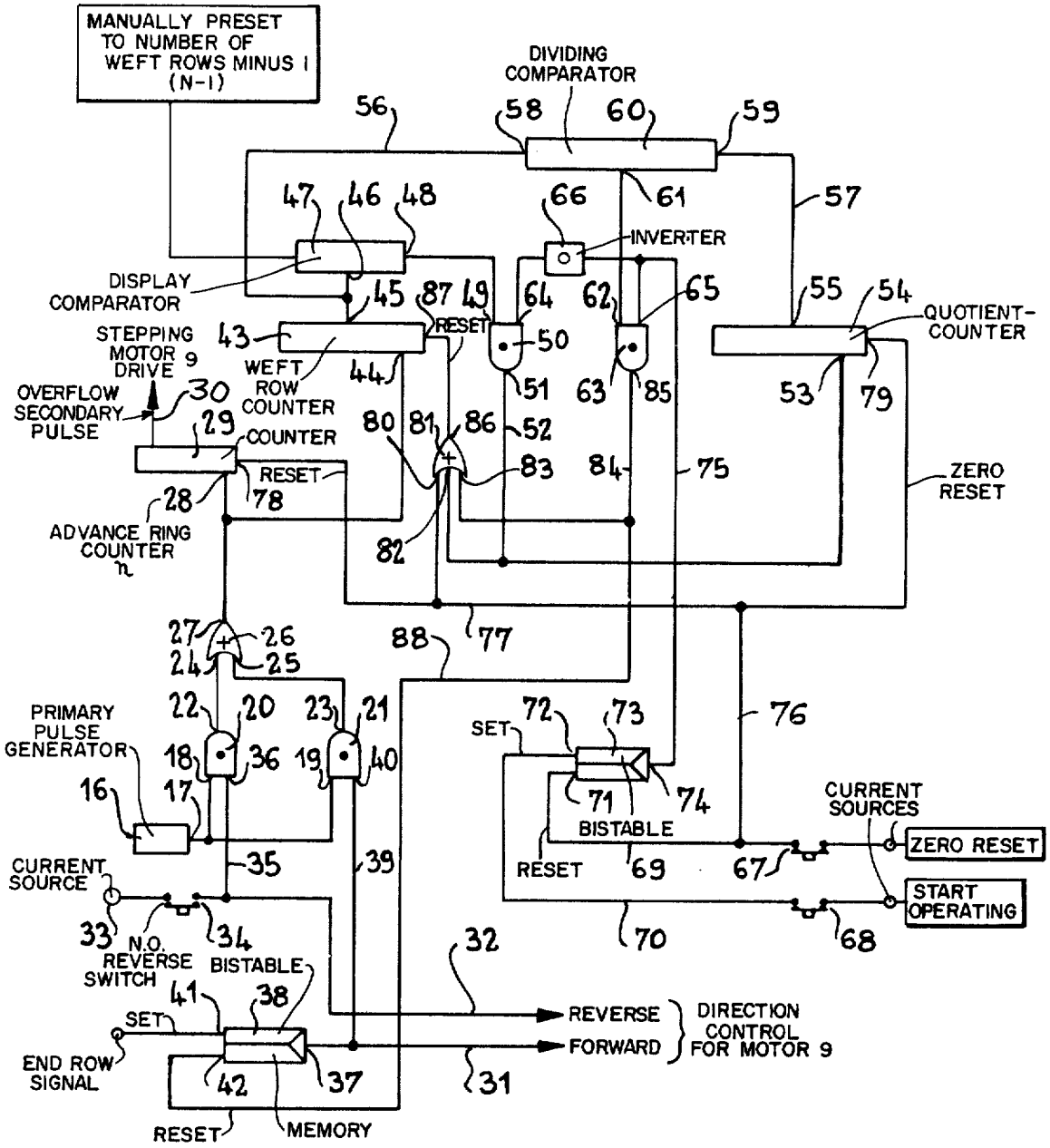
FIG. 3 shows the block diagram of a circuitry for the carrying into practice of the invention.

In the logic circuitry shown in FIG. 3, reference numeral 16 designates a free-running pulse generator adapted to emit "primary" pulses at a relatively high rate. The output 17 of generator 16 is connected with the first inputs, respectively 18, 19, of two AND gates 20, 21 the outputs, respectively 22, 23 of which are connected with the first and second inputs, respectively 24, 25 of an OR gate 26. The output 27 of OR gate 26 is connected with the input 28 of a first counter or advance counter 29. This counter is of the ring type, that is to say that it counts a number $n$ of pulses and returns to zero, and so on. Each time it passes from $n$ to zero, advance counter 29 generates on a first output 30 a "secondary" pulse which is applied to the motor 9 of FIGS. 1 and 2 to cause same to advance through one step.

The direction of rotation of motor 9 is determined by two conductors 31 and 32 which select respectively forward and backward running in response to each secondary pulse received by the said motor from the wire 30. The reverse selecting conductor 32, which remains normally ineffective during the reading operation of a weft row, is connected with a current source terminal 33 through a manual push-button switch 34. The output downstream of the push-button switch 34 (starting from terminal 33) is connected by a conductor 35 with the second input 36 of AND gate 20. As to the forward running selecting conductor 31 it receives electric current from the output 37 of a first bistable memory 38 which is connected by a conductor 39 with the second inlet of AND gate 21. Memory 38 has two inputs 41 and 42. The first one is adapted to receive an "end row" signal when the reading assembly 5 has read the last square of a weft row adjacent to the edge of the pattern. In the case of the arrangement illustrated in FIG. 1 no return stroke of the pattern beneath the reading assembly 5 is to be provided and the end row signal may be triggered by the rotation of drum 1 itself or by a cam associated therewith. In the case of FIG. 2 it may be assumed, for instance, that when the reading of a weft row is terminated, the table 10 beneath the reading assembly still advances to trigger a switch or the like which initiates the return stroke of the table 10 and emits the signal applied to inlet 41 to cause the motor 9 to move the assembly 5 into the next weft row to be scanned. Whatever may be the mounting selected, under the effect of this signal 41, the memory 38 generates an output adapted to set motor 9 for forward running. As to the second input 42 of memory 38, it is adapted to reset the memory to zero and thus to render the motor inoperative, as discussed below.

There is further provided a second counter or weft row counter 43, the input 44 of which is connected with the input 28 of the advance counter 29. The output 45 of this second counter 43 is connected in parallel with the input 46 of a first comparator or display comparator 47 having manually operated means, such as switches, whereby any desired number may be preset thereinto as a reference for comparison with the content of counter 43. When the content of counter 43 is equal to the reference number preset in display comparator 47, the latter generates a signal on an output 48 connected with the first input 49 of an AND gate 50, the output 51 of which is connected by a conductor 52 with the input 53 of a third counter or quotient counter 54. The output 55 of this third counter and the output 45 of the second counter 43 are connected by conductors 56, 57 with the first and the second inputs, respectively 58, 59 of a second comparator or divider comparator 60. When the contents of counters 43 and 54 are equal, comparator 60 emits a signal on its output 61 to the first input 62 of an AND gate 63. The second inputs 64, 65 of the AND gates 50 and 63 are connected with each other through an inverter 66.

The diagram of FIG. 3 further comprises two other manual push-button switches 67 and 68 which correspond respectively to the reset to zero and to the Start reading functions, these switches being connected by respective conductors 69 and 70 with the first and second inputs, respectively 71, 72, of a second bistable memory 73, the output 74 of which is connected by a conductor 75 with the second input 65 of AND gate 63 and, through inverter 66, with the second input 64 of AND gate 50. Conductor 69 is further connected by a conductor 76 with another conductor 77 which is connected with the respective zero reset inputs 78 and 79 of the advance counter 29 and of the quotient counter 54. This conductor 77 is further connected with the first input 80 of an OR gate 81 having three inputs. The second input 82 of gate 81 is connected with conductor 52, that is to say with the output of AND gate 50, while the third input 83 is connected by a conductor 84 with the output 85 of AND gate 63. The output 86 of OR gate 81 is connected with the zero reset input 87 of counter 43.

Finally a conductor 88 extends between conductor 84, that is to say the output 85 of AND gate 63, and the second input 42 of the first memory 38.

The operation is as follows:

It will be supposed that at rest counters 29, 43, 54 and memories 38, 73 are all at zero. During a preparatory step, the operator places in any appropriate manner the reading assembly in front of the crossing of the first warp row and of the last weft row of the design. He counts the number N of squares along the warp rows (at least if this number is not already known) and he manually enters the said number minus 1 or N − 1 in the display comparator 47 by means of the actuating switches of the latter. It should be noted that N of course obviously represents the number of wefts of the design and that N − 1 is therefore equal to the number of elementary displacements of the width of a weft row which should be imparted to the reading assembly to cause same to pass from the center of the first weft square to the center of the last weft square of the design. Then the operator actuates the reverse running push-button switch 34 which he maintains depressed. This has for its effect on the one hand to prepare motor 9 for backward running (through conductor 32), and on the other hand to enable AND gate 20 which then passes the primary pulses from generator 16. These pulses pass through OR gate 26 and thus reach the advance counter 29 which counts their total. Each time the number of primary pulses reaches the value *n* for which the counter has been set, the latter returns to zero and generates at its output 30 a secondary pulse which causes motor 9 to rotate through one angular step in the backward direction, that is to say in the right-to-left direction which corresponds to the return of the reading assembly towards the first weft row by traveling it along the first warp row of the design.

But at the same time the primary pulses from the output 27 of OR gate 26 also reach the input 44 of the weft row counter 43. Each time the counted number reaches a value equal to N − 1, i.e. to the number N of the weft rows of the design less one unit, the display comparator 47 finds coincidence with the number manually entered therein and emits a signal on its output 48. Memory 73 being presently at "0", the output of inverter 66 is at "1" and consequently AND gate 50 is conditioned to pass the signal from comparator 47. This signal is transmitted by conductor 52 to step the quotient counter 54 and also to the input 82 of OR gate 81 through which it passes to reach the zero reset input 87 of counter 43 which thus is enabled to again begins counting N − 1 primary pulses to again advance quotient counter 54 through one unit, and so on as long as button switch 34 is maintained closed. The dividing comparator 60 is ineffective during this operative step because the signal from its output 61 cannot pass through AND gate 63 the second input 65 of which is at "0" as is the outlet 74 of memory 73.

The operator releases the backward running push-button switch 34 in order to stop the return of the reading assembly when the latter reaches the center of the first weft row. If T designates the total number of primary pulses emitted by generator 16 during the operative step, it may be seen that when the reading assembly is fully returned, the counter 54 has registered the quotient $Q = T/N - 1$
with an error which corresponds to a division remainder lower than N − 1. In order to simplify the discussion, it may be first assumed that this error is equal to zero.

The operator then effects the reading step proper. For this purpose, he first actuates the push-button Start switch 68 which causes the output of bistable memory 73 to pass from "0" to "1", thus enabling AND gate 63 on its input 65 and disabling AND gate 50 on its input 64 through inverter 66 which transforms the "1" into "0". With the reading assembly aligned at the center of the first weft row, the system then proceeds in the conventional manner by moving the pattern for the purpose of displacing the reading assembly 5 of FIGS. 1 or 2 along the first weft row of the design 2. When the row is terminated the reading assembly 5 is returned towards the first wrap row to begin scanning again in a new weft row either automatically in the case of the drum of FIG. 1, or by a backward return stroke in the case of FIG. 2 using the drive 15 and the lead screws 13. But at the same time the end row signal reaches the input 41 of the first memory 38 and the output of the latter, which was initially at "0" during the preparatory step, thus passes to "1". This has two effects. First, motor 9 is switched to forward running by conductor 31, conductor 32 then being ineffective owing to the opening of push-button switch 34. Secondly AND gate 21 is enabled through its input 40, so that the primary pulses of generator 16, which could no longer pass through AND gate 20 to reach the input 24 of OR gate 26, may reach the other input 25 thereof through AND gate 21. Counter 29 then resumes its ring counting operation to advance motor 9 step-by-step in the direction to align the assembly 5 with the next weft row that is to say to displace the reading assembly in the warp direction from the first weft row to the second one.

However, since AND gate 50 is disabled, display comparator 47 can no longer advance quotient counter 54. Furthermore, owing to the enabling of AND gate 63, when weft row counter 43 has received a number of pulses equal to the quotient $Q = T/N - 1$ which is still registered in counter 54, the output then emitted by dividing comparator 60 follows conductor 84 and reaches input 83 of or gate 81 through which it passes to return counter 43 to zero, while at the same time it reaches memory 38 through conductor 88 and also returns this memory to zero, thus stopping the supply of the primary pulses to counters 29 and 43. Motor 9 is therefore stopped and it is easy to see that it has displaced the reading assembly through a distance equal to the spacing between the centers of two successive weft rows, since its angular displacement corresponds to the quotient representing the total number of primary pulses required to displace the said assembly from one extreme weft row to the other one on the design, divided by the number of such rows less one unit (N − 1 ), that is to say by the number of elementary displacements of the width of one weft row which are required to obtain the aforesaid total displacement across the pattern of the design.

The mechanism will then read the next weft row and when this reading it terminated, the same operating cycle of the motor 9 takes place.

The invention thus permits of realizing the automatic displacement of the reading assembly without having to take into account either the pitch of the paper rectangular coordinate between weft rows in the warp direction, or the possible dimensional variations of the said paper resulting from the ambient conditions.

As to the accuracy obtained, two points are to be noted:

1. Concerning the quotient $Q = T/N - 1$ any desired accuracy may be obtained by selecting a very large number of primary pulses to corrrespond to one advancing step of the motor.

2. As to the error which results from the fact that the displacement caused the fact that by one step of the motor is undivisible, the size of such a step need be made only smaller than the centering tolerance of the reading assembly, which is easily realized.

It should besides be noted that the preceding description is only illustrative and that anyone skilled in the art may imagine many modifications. For instance, instead of counting the number N of the weft rows it would be possible to count the number N′ of the lines of the rectangular coordinate paper, i.e. lines which assembly 5 intersects when it passes from the first weft row to the last one. It is easy to see that $N' = N - 1$ and that by proceeding in this manner it may be avoided that an inattentive operator should forget to effect the subtraction $N - 1$ and may manually enter N in comparator 47.

I claim:

1. The method of automatically moving a reading assembly to scan a rectangular coordinate weaving design pattern in the form of crossing weft rows and warp rows where the reading assembly and the pattern are advanced cyclically one with respect to the other, the advancing cycles bringing the reading head into alignment with successive weft rows by displacements within a predetermined tolerance from the center of one weft row to the center of the next weft row during each advancing cycle until the pattern has been scanned from the first weft row to the last weft row thereof, the improvement residing in displacing the reading assembly according to the following steps:

providing a series of electrical drive pulses;

coupling the drive pulses to displace the reading assembly in response to said pulses through a series of discrete increments each of which is smaller than said predetermined tolerance;

counting the total number of drive pulses required to displace the reading assembly across the pattern for a distance equal to the total distance between the center of the first weft row and the center of the last weft row;

dividing said total number of pulses by the number of weft rows to be actually traversed during said displacing of the reading assembly between the first and the last row to obtain the nearest integer as the quotient; and then automatically displacing the reading assembly through a number of discrete increments equal to said integer after each scanning of a weft row during an advancing cycle.

2. The method as set forth in claim 1, wherein said step of providing drive pulses includes the steps of generating a series of primary pulses at a rate which is high as compared with the rate of said drive pulses each of which represents an increment of displacement of the reading assembly and then dividing the primary pulses by a predetermined divisor to obtain said drive pulses, whereby it requires a predetermined number of primary pulses to displace the reading assembly through one increment, said predetermined divisor being selected such that the cumulative error in a series of increments resulting from the selection of the nearest integer as said quotient is less than said predetermined tolerance.

3. Apparatus for scanning and reading a rectangular coordinate weaving design pattern in the form of crossing warp rows and weft rows including a first weft row and a last weft row, comprising:

a photoelectric reading assembly disposed opposite means for supporting the design pattern;

means for moving the reading assembly and the design pattern relative to each other such that the reading assembly scans the pattern in the direction of the weft rows;

step-by-step motor means operative to displace the reading assembly through a fixed increment of motion in the direction of the warp for each step of the motor means;

means for generating a series of primary pulses;

motor actuating means coupled to receive said primary pulses and operative when enabled to deliver a secondary drive pulse to step said motor means through one increment in response to each generating of a predetermined number of primary pulses;

means to divide the number of primary pulses required to displace the reading assembly across the pattern for a distance equal to the distance between the center of the first weft row and the center of the last weft row by the number of weft rows that must be actually traversed during displacing of the reading assembly between the first and the last weft row to obtain a quotient selected as the nearest integer;

controlling means operative to disable said actuating means during scanning of each weft row and operative to enable said actuating means when a weft row has been scanned to the end of the row; and reversing means operative to disable said controlling means and to reverse the stepping direction of the motor and to enable the actuating means to deliver pulses to the motor to displace the reading assembly from the last weft row to the first weft row.

4. The apparatus as set forth in claim 3, wherein said actuating means comprises a first counter comprising a ring counter operative to deliver to the motor means a secondary pulse in response to each receiving of a predetermined number of primary pulses.

5. The apparatus as set forth in claim 3, wherein said means to divide includes a second counter connected to count the primary pulses from said generating means required to displace the reading assembly by one weft row and to deliver an output; first comparator means operative to compare the number of said outputs with the number of weft rows traversed during reversing of the motor means to move the reading assembly from the last weft row to the first weft row, the first comparator means delivering upon coincidence a reset pulse to reset the second counter to zero; and a third counter to count the reset pulses of the first comparator means during reversing of the motor means and to store the number of said reset pulses which is equal to said integer; and a second comparator means operative during enabling of the actuator means to pulse the motor means to displace the reading head from one weft row to the next, to compare the integer number stored in the third counter means with the number of pulses counted in the second counter means, and to deliver upon coincidence a reset pulse to disable the motor actuator means.

6. The apparatus as set forth in claim 3, said controlling means including gate means interposed between said pulse generating means and said actuating means.

* * * * *